US006689223B1

(12) United States Patent
Meine et al.

(10) Patent No.: US 6,689,223 B1
(45) **Date of Patent: *Feb. 10, 2004**

(54) WATER-CONTAINING MULTIPHASE CLEANING COMPOSITION BASED ON NONIONIC SURFACTANT

(75) Inventors: Georg Meine, Mettmann (DE); Ryzard Katowicz, Duesseldorf (DE); Ulf-Armin Schaper, Krefeld (DE); Alexander Ditze, Duesseldorf (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/632,562

(22) Filed: Aug. 4, 2000

(30) Foreign Application Priority Data

Aug. 6, 1999 (DE) ..... 199 36 727

(51) Int. Cl.[7] ..... B08B 7/00

(52) U.S. Cl. ..... 134/2; 134/40; 134/42; 510/417; 510/421; 510/424; 510/434; 510/480

(58) Field of Search ..... 510/417, 421, 510/424, 434, 480; 134/2, 40, 42

(56) References Cited

U.S. PATENT DOCUMENTS 4,348,292 A * 9/1982 Ginn ..... 510/406
6,180,587 B1 * 1/2001 Fuller et al. ..... 510/417
6,440,924 B1 * 8/2002 Jeschke et al. ..... 510/417

FOREIGN PATENT DOCUMENTS

| | | | |
|---|---|---|---|
| DE | 195 01 184 | | 7/1996 |
| DE | 195 01 187 | | 7/1996 |
| DE | 195 01 188 | | 7/1996 |
| DE | 198 59 774 | | 6/2000 |
| EP | 0 116 422 | | 8/1984 |
| EP | 0175485 A | * | 3/1986 |
| EP | 0 522 506 | | 1/1993 |
| GB | 2 134 916 | | 1/1984 |
| WO | WO 99/47634 A1 | * | 9/1999 |
| WO | WO 99/47635 A2 | * | 9/1999 |
| WO | WO 99/47635 | | 9/1999 |

* cited by examiner

*Primary Examiner*—Lorna M. Douyon
(74) *Attorney, Agent, or Firm*—Stephen D. Harper; Glenn E. J. Murphy

(57) ABSTRACT

A method of cleaning hard surfaces by contact with an aqueous, liquid, multiphase, surfactant-containing cleaning composition having at least two continuous phases, one lower aqueous phase I and an upper aqueous phase II immiscible with the lower phase I, which can be temporarily converted into an emulsion by shaking and which cleaning composition contains no more than 50% by weight of nonionic surfactants, based on the total quantity of surfactants present.

26 Claims, No Drawings

WATER-CONTAINING MULTIPHASE CLEANING COMPOSITION BASED ON NONIONIC SURFACTANT

BACKGROUND OF THE INVENTION

This invention relates to water-containing multiphase liquid cleaning compositions based on nonionic surfactant which can be temporarily emulsified by shaking and which may be used for cleaning hard surfaces, to a process for their production and to their use for cleaning hard surfaces.

Universal cleaners for all hard, wet- or damp-wipe surfaces in the domestic and institutional sectors are known as so-called multipurpose cleaners and are predominantly neutral to mildly alkaline, water-based liquid products which contain 1 to 30% by weight of surfactants, 0 to 5% by weight of builders (for example citrates, gluconates, soda, polycarboxy-lates), 0 to 10% by weight of hydrotropes (for example alcohols, urea), 0 to 10% by weight of water-soluble solvents (for example alcohols, glycol ethers) and optionally inter alia skin-care ingredients, dyes and perfumes. By contrast, for sanitary application as so-called bath cleaners, cleaning compositions of the type in question are often made acidic by addition of acids to enable lime and water stains to be better removed. Multipurpose cleaners are generally used in the form of a ca. 1% solution in water and, for local stain removal, may even be used in undiluted form. In addition, ready-to-use multipurpose cleaners are commercially available as so-called spray cleaners.

Aqueous liquid cleaners of the type in question are normally present as homogeneous stable solutions or dispersions. However, the effect of using certain, more especially hydrophobic, components in such cleaning compositions can be that this homogeneity is lost and inhomogeneous compositions with little chance of acceptance by the consumer are obtained. In cases such as these, there is a need for the alternative formulation of compositions which, despite their inhomogeneity, have a defined external appearance and form of use acceptable to the consumer.

European patent application 116 422 describes a liquid hair or body shampoo with two aqueous phases which can be temporarily dispersed in one another by shaking, the two phases being miscible with water in any ratio. The upper phase contains 8 to 25% by weight, based on the composition as a whole, of at least one surfactant while the lower phase contains at least 6% by weight, based on the composition as a whole, of dissolved sodium hexametaphosphate corresponding to formula I:

(I)

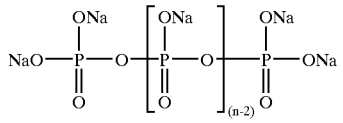

in which n stands for an average value of about 12. Other builder salts may optionally be present in the lower phase. Anionic, cationic, amphoteric and/or nonionic surfactants may be present as surfactants, at least one anionic surfactant preferably being present.

DE-OSS 195 01 184, '187 and '188 (Henkel KGaA) describe hair treatment compositions in the form of a 2-phase system which comprise an oil phase and a water phase, the oil phase being based on silicone oil or paraffin oil, and which can be rapidly mixed by mechanical action.

Unpublished German patent application 19859774.6 discloses a two-phase composition with a pH value of 9 consisting of 3% by weight of dodecylbenzenesulfonic acid, 2% by weight of $C_{10—14}$ fatty alcohol +1PO+1EO ether, 2% by weight of $C_{12-14}$ fatty alcohol +9EO butyl ether, 4% by weight of $C_{8-10}$ alkyl-1,5-glucoside, 8% by weight of citric acid $1H_2O$, 4.7% by weight of sodium hydroxide, 5% by weight of dioctyl ether, 0.9% by weight of perfume and, for the rest, water.

The problem addressed by the present invention was to provide high-performance storage-stable compositions for cleaning hard surfaces in a defined inhomogeneous, easy-to-handle and consumer-acceptable form.

DESCRIPTION OF THE INVENTION

The present invention relates to an aqueous, liquid, multiphase, surfactant-containing cleaning composition with at least two continuous phases which comprises at least one lower aqueous phase I and an upper aqueous phase II immiscible with the lower phase I, which can be temporarily converted into an emulsion by shaking and which contains more than 50% by weight of nonionic surfactants, based on the total quantity of surfactants present, excluding a composition with a pH of 9 consisting of 3% by weight of dodecylbenzenesulfonic acid, 2% by weight of $C_{10-14}$ fatty alcohol +1PO+1EO ether, 2% by weight of $C_{12-14}$ fatty alcohol +9EO butyl ether, 4% by weight of $C_{8-10}$ alkyl-1, 5-glucoside, 8% by weight of citric acid $1H_2O$, 4.7% by weight of sodium hydroxide, 5% by weight of dioctyl ether, 0.9% by weight of perfume and, for the rest, water.

The present invention also relates to the use of a composition according to the invention for cleaning hard surfaces.

In the context of the present invention, temporary means that 90% of the separation of the emulsion formed by shaking into the separate phases takes place over a period of 2 minutes to 10 hours at temperatures of about 20° C. to about 40° C., the remaining 2% of the separation into the phase state before shaking taking place over another 15 minutes to 50 hours.

According to the invention, it is also possible—unless otherwise specifically stated—to use a salt and also the corresponding acid/base pair of the salt which only gives the salt or a solution thereof in situ through neutralization, even though the particular alternative may not always be explicitly mentioned in the present teaching. In this sense, potassium citrate, for example, and the citric acid/potassium hydroxide or potassium alkyl benzenesulfonate combination and the alkyl benzenesulfonic acid/potassium hydroxide combination represent equivalent alternatives.

Finally, if a certain component can be used for various purposes in the context of the present invention, its use may intentionally be repeatedly described in the following. This applies, for example, to citric acid which is used both as an acid for pH adjustment and as a phase separation auxiliary and builder and to the anionic sulfonic acids which also act as acids and, in addition, as anionic surfactants.

The compositions according to the invention are distinguished by an unusually high cleaning performance against fatty soil when used in diluted or undiluted form. In addition, the compositions show favorable residue behavior. The individual phases in the composition remain stable for long periods without forming deposits, for example, and the conversion into a temporary emulsion remains reversible even after frequent shaking. The nonionic character of the nonionic surfactants presumably contributes to this. In addition, the compositions allow the stable incorporation of components—more particularly the hydrophobic components described hereinafter and perfume oils—which can only be stably incorporated in single-phase aqueous solutions or stable emulsions or microemulsions through the use of solvents, solubilizers or emulsifiers. In addition, the separation of ingredients into separate phases can promote the chemical stability of the composition.

Phases

In the most simple case, a composition according to the invention consists of a lower continuous phase, which consists of the entire phase I, and of an upper continuous phase which consists of the entire phase II. However, one or more continuous phases of a composition according to the invention may also contain parts of another phase in emulsified form so that, in a composition such as this, phase I for example is partly present as continuous phase I, which represents the lower continuous phase of the composition, and is partly emulsified as discontinuous phase I in the upper continuous phase II. The same applies to phase II and other continuous phases.

In one preferred embodiment of the invention, continuous phases I and II are separated from one another by a clearly defined phase boundary.

In another preferred embodiment of the invention, one or both of the continuous phases I and II contain(s) parts, preferably 0.1 to 25% by volume and more preferably 0.2 to 15% by volume, based on the volume of the particular continuous phase, of the other phase as dispersant. In this embodiment, the continuous phase I or II is reduced by that part by volume which is distributed as dispersant in the other phase. Particularly preferred compositions are those in which phase I is emulsified into phase II in quantities of 0.1 to 25% by volume and preferably in quantities of 0.2 to 15% by volume, based on the volume of phase II.

In another preferred embodiment of the invention, part of the two phases—in addition to the continuous phases I and II—is present as an emulsion of one of the two phases in the other phase, this emulsion being separated from those parts of phases I and II which are not involved in the emulsion by two clearly defined phase boundaries, namely an upper and a lower phase boundary.

The compositions according to the invention contain phase I and phase II in a ratio by volume of 90:10 to 10:90, preferably 75:25 to 25:75 and more preferably 65:35 to 35:65.

Surfactants

Besides nonionic surfactants, the compositions according to the invention may contain anionic, amphoteric or cationic surfactants or surfactant mixtures of one, several or all of these surfactant classes as their surfactant component. The compositions contain surfactants in quantities, based on the composition, of 0.01 to 30% by weight, preferably 0.1 to 20% by weight, more preferably 1 to 15% by weight, most preferably 3 to 12% by weight and, in one particularly preferred embodiment, 5 to 10% by weight, for example 6, 9, 9.1 or 9.2% by weight.

Nonionic Surfactants

Suitable nonionic surfactants are, for example, $C_{6-22}$ alkyl alcohol polyglycol ethers, alkyl polyglycosides and nitrogen-containing surfactants or even sulfosuccinic acid di-$C_{1-2}$-alkyl esters and mixtures thereof, more especially mixtures of the first two. The compositions contain nonionic surfactants in quantities, based on the composition, of 0.01 to 30% by weight, preferably 0.1 to 20% by weight, more preferably 0.5 to 14% by weight, most preferably 1 to 12% by, weight and, in one particularly preferred embodiment, 5 to 10% by weight, for example 5, 7.9 or 8% by weight. Based on the total quantity of surfactants present, the composition contains nonionic surfactants in a quantity of preferably 60 to 100% by weight, more preferably 70 to 95% by weight and most preferably 80 to 90% by weight, for example 83, 87 or 89% by weight.

$C_{6-22}$ alkyl alcohol polypropylene glycol/polyethylene glycol ethers are preferred known nonionic surfactants. They may be described by formula II, $R^1O—(CH_2CH(CH_3)O)_p(CH_2CH_2O)_e—H$, in which $R^1$ is a linear or branched, aliphatic alkyl and/or alkenyl group containing 8 to 22 carbon atoms, p is a 0 or a number of 1 to 3 and e is a number of 1 to 20.

The $C_{6-22}$ alkyl alcohol polyglycol ethers corresponding to formula II may be obtained by addition of propylene oxide and/or ethylene oxide onto alkyl alcohols, preferably onto oxoalcohols, the branched-chain primary alcohols obtainable by the oxosynthesis, or onto fatty alcohols, more particularly onto fatty alcohols. Typical examples are polyglycol ethers corresponding to formula II, in which $R^1$ is an alkyl group containing 8 to 22 carbon atoms, p=0 to 2 and e is a number of 2 to 7. Preferred representatives are, for example $C_{10-14}$ fatty alcohol+1PO+6EO ether (p=1, e=6), $C_{12-16}$ fatty alcohol+5.5 EO (p=0, e=5.5), $C_{12-18}$ fatty alcohol+7EO ether (p=0, e=7) and isodecanol +6EO ($R^1$= isomer mixture of $C_{10}$ oxoalcohol radicals, p=0, e=6) and mixtures thereof.

End-capped $C_{6-22}$ alkyl alcohol polyglycol ethers, i.e. compounds in which the free OH group in formula II is etherified, may also be used. The end-capped $C_{6-22}$ alkyl alcohol polyglycol ethers may be obtained by relevant methods of preparative organic chemistry. Preferably, $C_{6-22}$ alkyl alcohol polyglycol ethers are reacted with alkyl halides, more especially butyl or benzyl chloride, in the presence of bases. Typical examples are mixed ethers corresponding to formula II, in which $R^1$ is a technical fatty alcohol moiety, preferably a $C_{12/14}$ cocoalkyl moiety, p=0 and e=5 to 10, which are end-capped with a butyl group.

Other preferred nonionic surfactants are alkyl polyglycosides (APGs) corresponding to formula III, $R^2O[G]_x$, in which $R^2$ is a linear or branched, saturated or unsaturated alkyl group containing 8 to 22 carbon atoms, [G] is a glycosidic sugar unit and x is a number of 1 to 10. APGs are nonionic surfactants and are known materials which may be obtained by the relevant methods of preparative organic chemistry. The index x in general formula III indicates the degree of oligomerization (DP degree), i.e. the distribution of mono- and oligoglycosides, and is a number of 1 to 10. Whereas x in a given compound must always be an integer and, above all, may assume a value of 1 to 6, the value x for a certain alkyl glycoside is an analytically determined calculated quantity which is generally a broken number. Alkyl glycosides with an average degree of oligomerization x of 1.1 to 3.0 are preferably used. Alkyl glycosides with a degree of oligomerization of less than 1.7 and, more particularly, between 1.2 and 1.6 are preferred from the applicational point view. Xylose but especially glucose is preferably used as the glycosidic sugar.

The alkyl or alkenyl group $R^2$ (formula III may be derived from primary alcohols containing 8 to 22 and preferably 8 to 14 carbon atoms. Typical examples are caproic alcohol, caprylic alcohol, capric alcohol and undecyl alcohol and the technical mixtures thereof obtained, for example, in the hydrogenation of technical fatty acid methyl esters or in the hydrogenation of aldehydes from Roelen's oxosynthesis.

However, the alkyl or alkenyl group $R^2$ is preferably derived from lauryl alcohol, myristyl alcohol, cetyl alcohol, palmitoleyl alcohol, stearyl alcohol, isostearyl alcohol or oleyl alcohol. Elaidyl alcohol, petroselinyl alcohol, arachidyl alcohol, gadoleyl alcohol, behenyl alcohol, erucyl alcohol and technical mixtures thereof are also mentioned.

Other suitable nonionic surfactants are nitrogen-containing surfactants, for example fatty acid polyhydroxyamides, for example glucamides, and ethoxylates of alkyl amines, vicinal diols and/or carboxylic acid amides containing alkyl groups with 10 to 22 carbon atoms and preferably 12 to 18 carbon atoms. The degree of ethoxylation of these compounds is generally between 1 and 20 and preferably between 3 and 10. Ethanolamide derivatives of alkanoic acids containing 8 to 22 carbon atoms and preferably 12 to 16 carbon atoms are preferred. Particularly suitable compounds include lauric acid, myristic acid and palmitic acid monoethanolamides.

Anionic Surfactants

Suitable anionic surfactants are the preferred $C_{6-22}$ alkyl sulfates, $C_{6-22}$ alkyl ether sulfates, i.e. the sulfation products of alcohol ethers corresponding to formula II, and/or anionic sulfonic acids or salts thereof (sulfonates), but also $C_{6-22}$ carboxylic acid amide ether sulfates, sulfosuccinic acid mono-$C_{1-12}$-alkyl esters, $C_{6-22}$ alkyl polyglycol ether carboxylates, $C_{6-22}$ N-acyl taurides, $C_{6-22}$ N-sarcosinates and $C_{6-22}$ alkyl isethionates and mixtures thereof.

Anionic sulfonic acids in the context of the teaching according to the invention are sulfonic acids with the formula R-$SO_3H$ which bear a partly or completely linear and/or branched and/or cyclic and partly or completely saturated and/or unsaturated and/or aromatic $C_{6-32}$ hydrocarbon radical R, for example $C_{6-22}$ alkanesulfonic acids, $C_{6-22}$-α-olefin sulfonic acids, sulfonated $C_{6-22}$ fatty acids and $C_{1-22}$ alkyl-$C_{6-10}$-arenesulfonic acids, such as $C_{1-22}$ alkyl benzenesulfonic acids or $C_{6-22}$ alkyl naphthalenesulfonic acids, preferably linear $C_{8-16}$ alkyl benzenesulfonic acids, more particularly linear $C_{10-14}$ alkyl, $C_{10-13}$ alkyl and $C_{1-22}$ alkyl benzenesulfonic acids.

The anionic surfactants are used in the form of their alkali metal and alkaline earth metal salts, more especially sodium, potassium and magnesium salts, their ammonium and mono-, di-, tri- or tetraalkyl ammonium salts and—in the case of the anionic sulfonic acids—also in the form of the acid, for example dodecyl benzene sulfonic acid, $C_{10-13}$ alkyl benzenesulfonic acid and/or $C_{10-14}$ alkyl benzenesulfonic acid. Where sulfonic acid is used, it is normally neutralized in situ—partly or completely, depending on the pH to be adjusted in the composition—to form the salts mentioned using one or more corresponding bases, for example alkali metal and alkaline earth metal hydroxides, more particularly sodium, potassium and magnesium hydroxide, and also ammonia or mono-, di-, tri- or tetraalkyl amine. The compositions contain anionic surfactants in quantities, based on the composition, of 0 to less than 30% by weight, preferably 0.1 to 20% by weight, more preferably 0.5 to 10% by weight and most preferably 0.7 to 5% by weight, for example 1 or 1.2% by weight.

Where the particularly preferred alkyl benzenesulfonic acids are used, clouding can occur in the vicinity of the boundary layer between phases I and II, particularly with a high content of sodium chloride and/or where the pH is adjusted with sodium hydroxide. This problem is counteracted by the use of citric acid or citrate. A further improvement is obtained if the alkyl benzenesulfonic acid is neutralized with potassium hydroxide which has a particularly positive effect in this regard on phase separation, phase clarity and the definition of and substantial or complete absence of clouding in the phase boundary layer.

By virtue of their foam-suppressing and thickening properties, the compositions according to the invention may also contain soaps, i.e. alkali metal or ammonium salts of saturated or unsaturated $C_{6-22}$ fatty acids. The soaps may be used in a quantity of up to 5% by weight and preferably in a quantity of 0.1 to 2% by weight.

Amphoteric Surfactants

Suitable amphoteric surfactants are, for example, betaines corresponding to the formula $(R^3)(R^4)(R^5)N^+CH_2COO^-$, in which $R^3$ is a $C_{8-25}$ and preferably $C_{10-21}$ alkyl group optionally interrupted by hetero atoms or hetero atom groups and $R^4$ and $R^5$ may be the same or different and represent alkyl groups containing 1 to 3 carbon atoms, more especially $C_{10}$l22 alkyl dimethyl carboxymethyl betaine and $C_{11-17}$ alkylamidopropyl dimethyl carboxymethyl betaine. The compositions contain amphoteric surfactants in quantities, based on the composition, of 0 to 15% by weight, preferably 0.01 to 10% by weight and more preferably 0.1 to 5% by weight.

Cationic Surfactants

Suitable cationic surfactants are inter alia quatemary ammonium compounds with the formula $(R^6)(R^7)(R^8)(R^9)N^+X^-$, in which $R^6$ to $R^9$ stand for four identical or different, more especially two long-chain and two short-chain, alkyl groups and X is an anion, more particularly a halide ion, for example didecyl dimethyl ammonium chloride, alkyl benzyl didecyl ammonium chloride and mixtures thereof. The compositions contain cationic surfactants in quantities, based on the composition, of 0 to 10% by weight, preferably 0.01 to 5% by weight and more preferably 0.1 to 3% by weight.

In another preferred embodiment, the compositions according to the invention contain nonionic and anionic surfactants, preferably $C_{6-22}$ alkyl alcohol polyglycol ethers and/or alkyl polyglycosides together with $C_{6-22}$ alkyl benzenesulfonates, $C_{6-22}$ alkyl sulfates and/or $C_{6-22}$ alkyl ether sulfates, more particularly $C_{622}$ alkyl alcohol polyglycol ethers and $C_{6-22}$ alkyl benzenesulfonates.

Hydrophobic Components

In one particularly advantageous embodiment of the invention, the compositions contain one or more hydrophobic components. The hydrophobic components not only improve cleaning performance against hydrophobic soils, such as fatty soil, they also have a positive effect on phase separation and its reversibility. Here, the defined inhomogeneous form of the multiphase compositions according to the invention provides for the stable incorporation—even in relatively large quantities—of the hydrophobic components which can only be stably incorporated in single-phase aqueous solutions or stable emulsions or microemulsions in generally very limited quantities through the use of solvents, solubilizers and emulsifiers.

Suitable hydrophobic components are, for example, dialkyl ethers with like or different $C_{4-14}$ alkyl groups, more particularly linear dioctyl ethers; monomeric or homo- or heteropolymeric, more particularly monomeric and homo-, di- and trimeric $C_{2-4}$ alkylene glycols etherified or esterified with aliphatic or aromatic alcohols, for example methanol, ethanol, n-propanol, n-butanol, tert.-butanol or phenol, or carboxylic acids, for example acetic or carbonic acid, for example the products marketed under the name of Dowanol® by Dow Chemical and the products marketed under the names of Arcosolv® and Arconate® by Arco Chemical and listed below under their INCI names (International Dictionary of Cosmetic Ingredients published by The Cosmetic, Toiletry and Fragrance Association (CTFA), for example butoxy diglycol (Dowanol® DB), methoxydiglycol (Dowanol® DM), PPG-2 Methyl Ether (Dowanol® DPM), PPG-2 Methyl Ether Acetate (Dowanol® DPMA), PPG-2 Butyl Ether (Dowanol® DPnB), PPG-2 Propyl Ether (Dowanol® DPnP), Butoxyethanol (Dowanol® EB), Phenoxyethanol (Dowanol® EPh), Methoxyisopropanol (Dowanol® PM), PPG-1 Methyl Ether Acetate (Dowanol® PMA), Butoxyisopropanol (Dowanol®) PnB), Propylene Glycol Propyl Ether (Dowanol® PnP), Phenoxyisopropanol (Dowanol® PPh), PPG-3 Methyl Ether (Dowanol® TPM) and PPG-3 Butyl Ether (Dowanol® TPnB) and Ethoxyisopropanol (Arcosolv® PE), tert.-Butoxyisopropanol (Arcosolv® PTB), PPG-2 tert.-butyl ether (Arcosolv® DPTB) and Propylenecarbonate (Arconate® PC), more particularly PPG-2 Propyl Ether (dipropylene glycol-n-butyl ether, Dowanol® DPnP); hydrocarbons with a boiling range of 100 to 300° C., more particularly 140 to 280° C., for example aliphatic hydrocarbons with a boiling range of 145 to 200° C., isoparaffins with a boiling range of 200 to 260° C.; essential oils, more particularly limonene and the pine oil extracted from pine roots and stubs; and also mixtures of these hydrophobic components, more particularly mixtures of two or three of the hydrophobic components mentioned.

Preferred mixtures of hydrophobic components are mixtures of various dialkyl ethers, of dialkyl ethers and etherified or esterified monomeric or polymeric $C_{2-4}$ alkylene glycols, of dialkyl ethers and hydrocarbons, of dialkyl ethers and essential oils, of hydrocarbons and essential oils, of dialkyl ethers and hydrocarbons and essential oils and of these mixtures. Particularly preferred mixtures of hydrophobic components are mixtures of dialkyl ethers and etherified or esterified mono- or polymeric $C_2$alkylene glycols, for example of di-n-octyl ether and dipropyleneglycol-n-butyl ether (PPG-2 Propyl Ether).

The compositions contain hydrophobic components in quantities, based on the composition, of 0 to 20% by weight, preferably 0.1 to 15% by weight, more preferably 1 to 12% by weight, most preferable 2 to 10% by weight and, in one particularly advantageous embodiment, 3 to 78% by weight, for example 5% by weight.

Phase Separation Auxiliaries

The compositions according to the invention may contain one or more phase separation auxiliaries. Suitable phase separation auxiliaries are, for example, alkali metal and alkaline earth metal halides, more particularly chlorides, and sulfates and nitrates, more especially sodium and potassium chloride and sulfate, and ammonium chloride and sulfate and mixtures thereof. The salts mentioned, as strong electrolytes which increase ionic strength, assist phase separation through the salt effect. Sodium chloride has proved to be particularly effective. The compositions contain phase separation auxiliaries in quantities, based on the composition, of 0 to 30% by weight, preferably 1 to 20% by weight, more preferably 3 to 15% by weight and most preferably 5 to 12% by weight.

Builders

The compositions according to the invention may also contain one or more builders. Suitable builders are, for example, alkali metal citrates, gluconates, nitrilotriacetates, carbonates and bicarbonates, more especially sodium citrate, gluconate and nitrilotriacetate and sodium and potassium carbonate and bicarbonate, and alkali metal and alkaline earth metal hydroxides, more especially sodium and potassium hydroxide, ammonia and amines, more especially mono- and triethanolamine, and mixtures thereof. Other suitable builders are the salts of glutaric acid, succinic acid, adipic acid, tartaric acid and benzenehexacarboxylic acid and also phosphonates and phosphates, for example sodium hexametaphosphate such as, for example, a mixture of condensed orthophosphates corresponding to formula I, in which n has an average value of about 12. The compositions contain builders in quantities, based on the composition, of 0 to 30% by weight, preferably 0.1 to 20% by weight, more preferably 1 to 15% by weight and most preferably 2 to 10% by weight. The builder salts also act as phase separation auxiliaries.

A preferred builder is citrate from the group of alkali metal, alkaline earth metal, ammonium and mono-, di- or tri-alkanolammonium citrates, preferably mono-, di- or triethanolammonium citrates, or mixtures thereof, more particularly sodium citrate and most preferably potassium citrate, because citrates advantageously act both as builders and as phase separation auxiliaries.

A particularly preferred alkaline builder is potassium hydroxide because it has a particularly positive effect on phase separation, on the clarity and color brilliance of the phases and on the definition of and substantial or complete absence of clouding in the phase boundary layer.

If the builder is also intended to act as a pH-stabilizing buffer, alkali metal and alkaline earth metal carbonates and bicarbonates, for example soda, are preferred, more particularly together with citric acid or citrate optionally formed in situ from citric acid and hydroxide, for example sodium or potassium citrate, the ratio by weight—based on citric acid—of carbonate and/or bicarbonate to citric acid or citrate being 10:1 to 1:20, preferably 1:1 to 1:10, more preferably 1:3 to 1:7 and most preferably 1:3.5 to 1:6, for example 1:4 or 1:5.5.

Perfume Oils

The composition according to the invention preferably contains one or more perfume oils because, apart from their perfuming effect, they support phase separation and clearly improve cleaning performance, especially in quantities of more than 0.9% by weight. Perfume oils above all regularly present problems when incorporated in single-phase aqueous solutions or stable emulsions or microemulsions, particularly in relatively large quantities, and necessitate the use of solvents, solubilizers or emulsifiers although they are unable to stabilize relatively large perfume oil contents. The major advantage of the defined inhomogeneous form of the multiphase compositions according to the invention comes into play here, enabling the perfume oils to be stably incorporated, even in relatively large quantities.

Accordingly, the present invention also relates to the use of perfume oils in a liquid multiphase cleaning composition with at least two continuous phases, which comprises at least one lower aqueous phase I and an upper aqueous or non-aqueous phase II immiscible with the lower phase I and which can be temporarily converted into an emulsion by shaking, for improving cleaning performance. The composition according to this use is preferably an aqueous liquid multiphase surfactant-containing cleaning composition with at least two continuous phases which comprises at least one lower aqueous phase I and an upper aqueous phase II immiscible with the lower phase, more particularly a composition according to the invention.

The components of the suitable perfume oils described in the following are followed by numbers in brackets, for example "(5.0)", which represent exemplary data on the composition of the particular perfume oil in o by weight, based on the perfume oil. Thus, "geraniol (105.0)" means that the perfume oil can contain geraniol, for example, in a quantity of 105.0% by weight.

A suitable perfume oil with a fresh fruity note contains, for example, dynascone 10 (5.0), cyclovertal (7.5), hexyl acetate (35.0), allyl heptanoate (200.0), amyl butyrate (5.0), prenyl acetate (10.0), aldehyde C 14 SOG (70.0), manzanate (15.0), melusate (30.0), ortho-tert.-butyl cyclohexyl acetate (200.0), cinnamaldehyde (5.0), isobomyl acetate (10.0), dihydrofloriffone TD (2.5), floramate (100.0), phenylethyl alcohol (30.0), geraniol (105.0), cyclohexyl salicylate (150.0) and citronellol (20.0).

A suitable perfume oil with a fresh flowery note contains, for example, bergamot oil (250.0), citrus oil messina (50.0), citronellal (2.0), orange oil sweet (50.0), lavender oil (50.0), terpineol (50.0), lilial (100.0), phenyl ethyl alcohol (80.0), citronellol (100.0), geraniol (20.0), benzyl acetate (60.0), isoraldein 70 (50.0), ylang (30.0), Ambroxan 10% in IPM (1.0), heliotropin (47.0) and habanolide (60.0).

A suitable perfume oil with a citrus note contains, for example, orange oil (710.0), α-pinene (130.0), β-pinene (20.0), γ-terpinene (95.0) and litsea cubeba oil (55.0).

The content of one or more perfume oils is normally 0.1 to 15% by weight, preferably 0.5 to 10% by weight, more preferably from 1 to 5% by weight, most preferably from 1.5 to 4% by weight and, in one particularly advantageous embodiment, 2 to 3% by weight, for example 2.5% by weight.

Enzymes

In one particular embodiment of the invention, the composition contains one or more enzymes.

Suitable enzymes are any of the enzymes typically used in detergents and cleaning compositions, for example proteases (for example BLAP 260 L®, BLAP S 260 SLD®, BLAP S 260 ALD®, BLAP S 260 LD®) and BLAP S 260O® from Biozym or Durazym®, Savinase® and Alcalase® from Novo Nordisk), amylases (for example Termamyl®) from Novo Nordisk), cellulases (for example KAC 500® from Kao, Celluzyme® from Novo Nordisk), lipases (for example Lipolase 100 L® and Lipolase 100 T® from Novo Nordisk) and peroxidases and reductases.

The nonionic surfactants in general and the alkyl polyglycosides in particular improve the storage stability of the enzyme-containing embodiment in the same way as citric acid and its salts and also the hydrophobic components, more particularly the optionally etherified or esterified monomeric or polymeric $C_{2-4}$ alkylene glycols, for example the products marketed under the names of Dowanol®, Arcosolv® and Arconate® and polyethylene glycols and derivatives thereof. The multiphase character of the composition according to the invention has an advantageous effect on the stability of the enzymes which is presumably attributable to the concentration of the enzymes in the upper phase II which is richer in the stabilizing components mentioned above and—in terms of ionic strength—less ionic.

Antimicrobial Agents

To control microorganisms, the cleaning composition may contain antimicrobial agents. Depending on the antimicrobial spectrum and the action mechanism, antimicrobial agents are classified as bacteriostatic agents and bactericides, fungistatic agents and fungicides, etc. Important representatives of these groups are, for example, benzalkonium chlorides, alkylaryl sulfonates, halophenols and phenol mercuriacetate. In the present context, the expressions "antimicrobial activity" and "antimicrobial agent" have the usual meanings as defined, for example, by K. H. Wallhäulβer in "Praxis der Sterilisation, Desinfektion—Konservierung Keimidentifizierung—Betriebshygiene" (5th Edition, Stuttgart/New York: Thieme, 1995), any of the substances with antimicrobial activity described therein being usable. Suitable antimicrobial agents are preferably selected from the groups of alcohols, amines, aldehydes, antimicrobial acids and salts thereof, carboxylic acid esters, acid amides, phenols, phenol derivatives, diphenyls, diphenylalkanes, urea derivatives, oxygen and nitrogen acetals and formals, benzamidines, isothiazolines, phthalimide derivatives, pyridine derivatives, antimicrobial surface-active compounds, guanidines, antimicrobial amphoteric compounds, quinoliries, 1,2-dibromo-2,4-dicyanobutane, iodo-2-propyl butyl carbamate, iodine, iodophores, peroxo compounds, halogen compounds and mixtures of the above.

The antimicrobial agent may be selected from ethanol, n-propanol, i-propanol, butane-1,3-diol, phenoxyethanol, 1,2-propylene glycol, glycerol, undecylenic acid, benzoic acid, salicylic acid, dihydracetic acid, o-phenylphenol, N-methyl morpholine acetonitrile (MMA), 2-benzyl-4-chlorophenol, 2,2'-methylene-bis-(6-bromo-4-chlorophenol), 4,4'-dichloro-2'-hydroxydiphenyl ether (dichlosan), 2,4,4'-trichloro-2'-hydroxydiphenyl ether (trichlosan), chlorohexidine, N-(4-chlorophenyl)-N-3,4-dichlorophenyl)-urea, N,N'-(1,10-decanediyldi-1-pyridinyl-4-ylidene)-bis-(1-octanamine)-dihydrochloride, N,N'-bis-(4-chlorophenyl)-3,12-diimino-2,4,11,13-tetraazatetradecane diimidoamide, glucoprotamines, antimicro-bial surface-active quaternary compounds, guanidines, including the bi- and polyguanidines such as, for example, 1,6-bis-(2-ethylhexylbi-guanidohexane)-dihydrochloride, 1,6-di-($N_1$,$N_1$'-phenyldiguanido-$N_5$,$N_5$')-hexane tetrahydrochloride, 1,6-di-($N_1$,$N_1$'-phenyl-$N_1$,$N_1$-methyldiguanido-$N_5$,$N_5$')-hexane dihydrochloride, 1,6-di-($N_1$,$N_1$'-o-chlorophenyldiguanido-$N_5$,$N_5$')-hexane dihydrochloride, 1,6-di-($N_1$,$N_1$'-2,6-dichlorophenyidiguanido-$N_5$,$N_5$')-hexane dihydrochloride, 1,6-di-[$N_1$,$N_1$'-β-(p-methoxyphenyl)-diguan-ido-$N_5$,$N_5$']-hexane dihydrochloride, 1,6-di-($N_1$,$N_1$'-α-methyl-β-phenyldiguan-ido-$N_5$,$N_5$'-hexane dihydrochloride, 1,6-di-($N_1$,$N_1$'-p-nitrophenyldiguanido-$N_5$,$N_5$')-hexane dihydrochloride, ω:ω-di-($N_1$,$N_1$'-phenyldiguanido-$N_5$,$N_5$')-di-n-propyl ether dihydrochloride, ω:ω'-di-($N_1$,$N_1$'-p-chlorophenyldiguanido-$N_5$,$N_5$')-di-n-propyl ether tetrahydrochloride, 1,6-di-($N_1$,$N_1$'-2,4-dichloro-phenyidiguanido-$N_5$,$N_5$')-hexane tetrahydrochloride, 1,6-di-($N_1$,$N_1$'-p-methyl-phenyidiguanido-$N_5$,$N_5$')-hexanedihydrochloride, 1,6-di-($N_1$,$N_1$'-2,4,5-trichlorophenyidiguanido-$N_5$,$N_5$')-hexane tetrahydrochloride, 1,6-di-[$N_1$,$N_1$'-α-(p-chlorophenyl)-ethyldiguanido-$N_5$,$N_5$]-hexane dihydrochloride, ω:ω-di-($N_1$,$N_1$'-p-chlorophenyidiguanido-$N_5$,$N_5$')-m-xylene dihydrochloride, 1,12-di-($N_1$,$N_1$'-p-chlorophenyldiguanido-$N_5$,$N_5$')-dodecane dihydrdochloride, 1,10-di-($N_1$,$N_1$'-phenyldiguanido-$N_5$,$N_5$')-decane tetrahydrochloride, 1,12-di-($N_1$,$N_1$'-phenyldiguanido-$N_5$,$N_5$')-dodecane tetrahydrochloride, 1,6-di-($N_1$,$N_1$'-o-chlorophenyidiguanido-$N_5$,$N_5$')-hexane dihydrochloride, 1,6-di-($N_1$,$N_1$'-o-chlorophenyldiguanido-$N_5$,$N_5$')-hexane tetrahydrochloride, ethylene-bis-(1-tolylbiguanide), ethylene-bis-(p-tolylbiguanide), ethylene-bis-(3,5-dimethylphenylbiguanide), ethylene-bis-(p-tert.amylphenyl-biguanide), ethylene-bis-(nonylphenylbiguanide), ethylene-bis-(phenyl-biguanide), ethylene-bis-(N-butylphenylbiguanide), ethylene-bis-(2,5-diethoxyphenylbiguanide), ethylene-bis-(2,4-dimethylphenylbiguanide), ethylene-bis-(o-diphenylbiguanide), ethylene-bis-(mixed-amylnaphthyl-biguanide), N-butylethylene-bis-(phenylbiguanide), trimethylene-bis-(o-tolylbiguanide), N-butyltrimethylene-bis-(phenylbiguanide) and the corresponding salts, such as acetates, gluconates, hydrochlorides, hydrobromides, citrates, bisulfites, fluorides, polymaleates, N-cocoalkyl sarcosinates, phosphites, hypophosphites, perfluorooctanoates, silicates, sorbates, salicylates, maleates, tartrates, fumarates, ethylenediamine tetraacetates, iminodiacetates, cinnamates, thiocyanates, arginates, pyromellitates, tetracarboxybutyrates, benzoates, glutarates, monofluorophosphates, perfluoropropionates and mixtures thereof. Halogenated xylene and cresol derivatives, such as p-chloro-m-cresol or p-chloro-m-xylene, and natural antimicrobial agents of vegetable origin (for example from spices or herbs), animal and microbial origin are also suitable. Preferred antimicrobial agents are antimicrobial surface-active quaternary compounds, a natural antimicrobial agent of vegetable origin and/or a natural antimicrobial agent of animal origin and, most preferably, at least one natural antimicrobial agent of vegetable origin from the group comprising caffeine, theobromine and theophylline and essential oils, such as eugenol, thymol and geraniol, and/or at least one natural antimicrobial agent of animal origin from the group comprising enzymes, such as protein from milk, lysozyme and lactoperoxidase and/or at least one antimicrobial surface-active quaternary compound containing an ammonium, sulfonium, phosphonium, iodonium or arsonium group, peroxo compounds and chlorine compounds. Substances of microbial origin, so-called bacteriozines, may also be used.

Also suitable are the following antimicrobial agents named according to the INCI (Intentional Nomenclature Cosmetic Ingredients) nomenclature (see also International Cosmetic Ingredient Dictionary and Handbook—Seventh Edition (1997), published by The Cosmetic, Toiletry and Fragrance Association (CTFA), 1101 17th Street, NW, Suite 300, Washington, DC 20036, USA): Alcohol, Benzalkonium Chloride, Benzethonium Chloride, *Camellia Sinensis* Leaf Extract, *Candida Bombicola*/Glucose/Methyl, Rapeseedate Ferment, Hydrogen Peroxide, Methylbenzethonium Chloride, Phenol, *Pinus Pinaster* Bark Extract, *Pinus Tabulaeformis* Bark Extract, Poloxamer 188, PVP-Iodine, *Rosmarinus Officinalis* (Rosemary) Leaf Extract and *Vitis Vinifera* (Grape) Seed Extract.

The quaternary ammonium compounds (QUATS) suitable as antimicrobial agents have the general formula $(R^1)(R^2)(R^3)(R^4)N^+ X^-$, in which $R^1$ to $R^4$ may be the same or different and represent $C_{1-22}$ alkyl groups, $C_{7-28}$ aralkyl groups or heterocyclic groups, two or—in the case of an aromatic compound, such as pyridine—even three groups together with the nitrogen atom forming the heterocycle, for example a pyridinium or imidazolinium compound, and $X^-$ represents halide ions, sulfate ions, hydroxide ions or similar anions. In the interests of optimal antimicrobial activity, at least one of the substituents preferably has a chain length of 8 to 18 and, more preferably, 12 to 16 carbon atoms.

QUATS can be obtained by reaction of tertiary amines with alkylating agents such as, for example, methyl chloride, benzyl chloride, dimethyl sulfate, dodecyl bromide and also ethylene oxide. The alkylation of tertiary amines with one long alkyl chain and two methyl groups is particularly simple. The quaternization of tertiary amines containing two long chains and one methyl group can also be carried out under mild conditions using methyl chloride. Amines containing three long alkyl chains or hydroxy-substituted alkyl chains lack reactivity and are preferably quaternized with dimethyl sulfate.

Suitable QUATS are, for example, benzalkonium chloride (N-alkyl-N,N-dimethylbenzyl ammonium chloride, CAS No. 8001-54-5), benzalkon B (m,p-dichlorobenzyl dimethyl-$C_{12}$-alkyl ammonium chloride, CAS No. 58390-78-6), benzoxonium chloride (benzyldodecyl-bis-(2-hydroxyethyl)-ammonium chloride), cetrimonium bromide (N-hexadecyl-N,N-trimethyl ammonium bromide, CAS No. 57-09-0), benzetonium chloride (N,N-di-methyl-N-[2-[2-[p-(1,1,3,3-tetramethylbutyl)-phenoxy]-ethoxy]-ethyl]-benzyl ammonium chloride, CAS No. 121-54-0), dialkyl dimethyl ammonium chlorides, such as di-n-decyldimethyl ammonium chloride (CAS No. 7173-51-5-5), didecyldimethyl ammonium bromide (CAS No. 2390-68-3), dioctyl dimethyl ammonium chloride, 1-cetylpyridinium chloride (CAS No. 123-03-5) and thiazoline iodide (CAS No. 1576448-1) and mixtures thereof. Particularly preferred QUATS are the benzalkonium chlorides containing $C_{8-18}$ alkyl groups, more particularly $C_{12-14}$ alkyl benzyl dimethyl ammonium chloride.

Benzalkonium halides and/or substituted benzalkonium halides are commercially obtainable, for example, as Barquat® from Lonza, Marquato® from Mason, Variquat® from Witco/Sherex and Hyamine® from Lonza and as Bardac® from Lonza. Other commercially obtainable antimicrobial agents are N-(3-chloroallyl)-hexaminium chloride, such as Dowicide® and Dowicil® from Dow, benzethonium chloride, such as Hyamine® 1622 from Rohm & Haas, methyl benzethonium chloride, such as Hyamine® 10X from Rohm & Haas, cetyl pyridinium chloride, such as cepacolchloride from Merrell Labs.

The antimicrobial agents are used in quantities of normally 0.001% by weight to 10% by weight, preferably 0.01% by weight to 5% by weight, more preferably 0.1% by weight to 3% by weight and most preferably 0.5 to 2% by weight, for example 1 to 1.5% by weight.

pH Value

The pH value of the compositions according to the invention may be varied over a broad range from the strongly acidic via neutrality to the highly alkaline, although a pH in the range from 1 to 12 and more particularly in the range from 2 to 11 is preferred. In the context of the invention, the pH value of the compositions according to the invention is understood to be the pH value of the composition in the form of the temporary emulsion.

In a neutral embodiment, the pH value is above 6 to below 8, preferably in the range from 6.5 to 7.5 and more preferably about 7.

In a preferred embodiment of the invention, the compositions are alkaline with a pH in the range from 8 to 12, preferably 8 to 11 and more preferably 8 to 10.5, for example 8 to 9, for example 8.3 for moderate alkalinity or above 9 to 10.5, 11 or even 12, for example 10, for relatively strong alkalinity.

Suitable pH regulators are on the one hand acids such as the mineral acids, for example hydrochloric acid, but especially citric acid, and on the other hand the above-mentioned alkaline builders, preferably sodium hydroxide but especially potassium hydroxide by virtue of the advantages already mentioned.

In order to stabilize or buffer its pH value, the composition according to the invention—in one particular embodiment—contains small quantities of corresponding buffer substances, for example soda or sodium bicarbonate in the described alkaline embodiment.

In another preferred embodiment of the invention, the compositions are acidic with a pH value in the range from 1 to 6, preferably 2 to 6, more preferably 3 to 5.5 and most preferably 3.5 to 5, for example 4, 4.4 or 4.5. To adjust such a pH value, the compositions contain at least one acid. Suitable acids are inorganic acids, for example the mineral acids, for example hydrochloric acid, and organic acids, for example saturated or unsaturated $C_{1-6}$ mono-, di- and tricarboxylic acids and hydroxycarboxylic acids containing one or more hydroxy groups, for example citric acid, maleic acid, formic acid and acetic acid, amidosulfuric acid, $C_{6-22}$ fatty acids and anionic sulfonic acids, and mixtures thereof, for example the succinic acid/glutaric acid/adipic acid mixture obtainable from BASF under the name of Sokalan® DCS. Particularly preferred acids are citric acid, preferably used in the form of its monohydrate citric acid.$1H_2O$, and anionic sulfonic acids and combinations of citric acid with one or more anionic sulfonic acids, more particularly with alkylarenesulfonic acids. Citric acid advantageously combines acid, builder and phase transfer auxiliary properties while the anionic sulfonic acids act both as acid and as anionic surfactant. One or more alkalis, for example the alkali metal, alkaline earth metal and ammonium hydroxides and carbonates and ammonia, preferably sodium and potassium hydroxide, especially potassium hydroxide, may also be used.

Viscosity

The viscosity of the composition according to the invention at 20° C. is preferably in the range from 5 to 1,000 mPa·s, more preferably in the range from 10 to 500 mPa·s and most preferably in the range from 10 to 200 mPa·s, as measured with a Brookfield LVT or LVDV-II rotational viscosimeter with small sample adapter at a rotational speed of 30 $min^{-1}$, the Brookfield spindle used as the measuring element having to be selected so that the torque is in a favorable range and the measuring range is not exceeded. Within these limits, spindle 31 is preferred although, if necessary, it is possible with advantage to resort to spindle 25 for viscosities above about 240 mPa·s.

Thickeners

For viscosity adjustment, the composition according to the invention may contain one or more thickeners, preferably in a quantity of 0.01 to 5% by weight, more preferably in a quantity of 0.05 to 2.5% by weight and most preferably in a quantity of 0.1 to 1% by weight.

Suitable thickeners are organic natural thickeners (agar agar, carrageen, tragacanth, gum arabic, alginates, pectins, polyoses, guar gum, locust bean gum, starch, dextrins, gelatine, casein), organic modified natural substances (carboxymethyl cellulose and other cellulose ethers, hydroxyethyl and hydroxypropyl cellulose and the like, gum ethers), organic fully synthetic thickeners (polyacrylic and polymethacrylic compounds, vinyl polymers, polycarboxylic acids, polyethers, polyimines, polyamides) and inorganic thickeners (polysilicic acids, clay minerals, such as montmorillonites, zeolites, silicas).

The polyacrylic and polymethacrylic compounds include, for example, the high molecular weight homopolymers of acrylic acid crosslinked with a polyalkenyl polyether, more particularly an allyl ether of sucrose, pentaerythritol or propylene (INCI name according to the Intentional Dictionary of Cosmetic Ingredients of The Cosmetic, Toiletry and Fragrance Association (CTFA): Carbomer), which are also known as carboxyvinyl polymers. Polyacrylic acids such as these are obtainable inter alia from B.F. Goodrich under the name of Carbopol®, for example Carbopol® 940 (molecular weight ca. 4,000,000), Carbopol® 941 (molecular weight ca. 1,250,000) or Carbopol® 934 (molecular weight ca. 3,000,000). The thickeners in question also include the following acrylic acid copolymers: (i) copolymers of two or more monomers from the group of acrylic acid, methacrylic acid and their simple esters preferably formed with $C_{14}$ alkanols (INCI Acrylates Copolymer), which include for example the copolymers of methacrylic acid, butyl acrylate and methyl methacrylate (CAS—Chemical Abstracts Service—code: 250235-69-2) or of butyl acrylate and methyl methacrylate (CAS 25852-37-3) and which are obtainable, for example, from Rohm & Haas under the names of Aculyn® and Acusol®, for example the anionic non-associative polymers Aculyn® 33 (crosslinked), Acusol® 810 and Acusol®) 830 (CAS 25852-37-3); (ii) crosslinked high molecular weight acrylic acid copolymers which include, for example, the copolymers of $C_{10-30}$ alkyl acrylates—crosslinked with an allyl ether of sucrose or pentaerythritol—with one or more monomers from the group of acrylic acid, methacrylic acid and their simple esters preferably formed with $C_{1-4}$ alkanols (INCI Acrylates/10–30 Alkyl Acrylate Crosspolymer) and which are obtainable, for example, from B.F. Goodrich under the name of Carbopol®, for example the hydrophobicized Carbopol® ETD 2623 and Carbopol® 1382 (INCI Acrylates/C10–30 Alkyl Acrylate Crosspolymer) and Carbopol® AQUA 30 (formerly Carbopol® EX 473).

Preferred thickeners are the polysaccharides and heteropolysaccharides, more particularly the polysaccharide gums, for example gum arabic, agar, alginates, carrageens and salts thereof, guar, guaran, tragacanth, gellan, ramsan, dextran or xanthan and derivatives thereof, for example propoxylated guar, and mixtures thereof. Other polysaccharide thickeners, such as starches or cellulose derivatives, may be used alternatively, but preferably additionally to a polysaccharide gum, for example starches of varying origin and starch derivatives, for example hydroxyethyl starch, starch phosphate esters and starch acetates, or carboxymethyl cellulose or its sodium salt, methyl, ethyl, hydroxyethyl, hydroxypropyl, hydroxypropyl methyl or hydroxyethyl methyl cellulose or cellulose acetate.

A particularly preferred polymer is the microbial anionic heteropolysaccharide xanthan gum which is produced by *Xanthomonas campestris* and a few other species under aerobic conditions and which has a molecular weight of 2 to $15\times10^6$. This polymer is obtainable, for example, under the name of Keltrol®, for example as the cream-colored powder Keltrol® T (transparent) or the white granules Keltrol® RD (readily dispersible).

Auxiliaries and Additives

Besides the components mentioned, the compositions according to the invention may contain other auxiliaries and additives of the type typically present in such compositions. These include in particular polymers, soil release agents, solvents (for example ethanol, isopropanol, glycol ether), solubilizers, hydrotropes (for example sodium cumenesulfonate, octyl sulfate, butyl glucoside, butyl glycol), cleaning boosters, disinfectants, antistatic agents, preservatives (for example glutaraldehyde), bleaching systems and dyes and also opacifiers or even skin care agents as described in EP-A-522 556. The quantity in which such additives are present in the cleaning composition is normally not more than 12% by weight. The lower limit depends upon the nature of the auxiliary/additive and, in the case of dyes for example, may be at 0.001% by weight or lower. The auxiliaries/additives are preferably present in a quantity of 0.01 to 7% by weight and more preferably in a quantity of 0.1 to 4% by weight.

A preferred auxiliary and additive are dyes, for example Solvent Green 7 and/or Reactive Yellow 25 (names according to the Color Index of the Society of Dyers and Colorists), because the phases can be differently colored by adding them which facilitates the visual perception of the separated phases and makes formation and separation of the emulsion easier to follow, so that the composition is made even easier to handle.

The compositions according to the invention can be prepared by mixing directly from their raw materials, subsequent further mixing and, finally, leaving the composition to stand in order to separate the temporary emulsion. Accordingly, the present invention also relates to a process for the production of composition according to the invention by mixing directly from its raw materials, subsequent further mixing and, finally, leaving the composition to stand in order to separate the temporary emulsion.

The reversible phase separation is caused and determined in its characteristics by the complex interplay of a number of components. The surfactant present can lead on its own to the phase separation according to the invention. Phase separation may be brought about through the additional use of the hydrophobic component. If not, phase separation auxiliaries would have to be used.

EXAMPLES

Compositions E1 to E6 according to the invention were prepared as described in the foregoing. Table 1 below shows the composition in % by weight, the pH value and the quantified ratio by volume of the upper phase II to the lower phase I.

TABLE 1

| Composition | E1 | E2 | E3 | E4 | E5 | E6 |
|---|---|---|---|---|---|---|
| $C_{12-18}$ fatty alcohol + 7 EO | 1.0 | 1.0 | — | — | — | — |
| $C_{12-16}$ fatty alcohol + 5 EO | — | — | 1.5 | 1.5 | 1.5 | 1.5 |
| Isodecanol + 6 EO | 4.0 | 7.0 | 6.4 | 6.5 | 6.5 | 6.5 |
| $C_{10-13}$ ABS acid | 1.0 | 1.0 | 1.2 | 1.2 | 1.2 | 1.2 |
| PPG-2 Butyl Ether | 3.0 | 3.0 | 5.0 | 5.0 | 5.0 | 5.0 |
| Di-n-octyl ether | 2.0 | 2.0 | — | — | — | — |
| Na cumene-sulfonate | — | — | 2.0 | 2.0 | 2.0 | 1.0 |
| Citric acid.$H_2O$ | 7.0 | 3.0 | 5.5 | 4.0 | 8.5 | 7.0 |
| KOH | 5.7 | 2.59 | 4.7 | — | — | — |
| NaOH | | — | — | 2.56 | 2.95 | 2.7 |
| Sodium bicarbonate | — | — | 1.0 | 1.0 | — | — |
| Perfume oil (see below) | 2.0 | 2.5 | 2.0 | 2.0 | 2.0 | 3.0 |
| Glutaraldehyde | — | 0.05 | 0.05 | 0.05 | — | — |
| Solvent Green 7 | — | +[a] | — | — | — | — |
| Reactive Yellow 25 | + | + | + | + | + | + |
| Water, deionized | to 100 | to 100 | to 100 | to 100 | to 100 | to 100 |
| pH value | 4.0 | 10.0 | 8.3 | 8.3 | 4.4 | 4.5 |
| Appearance phase II/phase I | Cloudy/almost clear | Almost clear/clear | Clear/almost clear | Clear/almost clear | Clear/almost clear | Clear/almost clear |
| Ratio by volume II:I | 45:55 | 60:40 | 50:50 | 50:50 | 50:50 | 40:60 |
| Color phase II/phase I | Yellow/colorless | Yellow/light yellow | Yellow/colorless | Yellow/colorless | Yellow/colorless | Yellow/colorless |

[a]<0.01% by weight

Compositions E1 to E6 contained a perfume oil with a citrus note consisting of 700.0% by weight orange oil, 130.0% by weight α-pinene, 20.0% by weight β-pinene, 95.0% by weight γ-terpinene and 55.0% by weight *litsea cubeba* oil.

Compositions E1'/to E6' were similarly prepared but, in contrast to compositions E1 to E6, contained a perfume oil with a fresh fruity note consisting of 5.0% by weight dynascone 10, 7.5% by weight cyclovertal, 35.0% by weight hexyl acetate, 200.0% by weight allyl heptanoate, 5.0% by weight amyl butyrate, 10.0% by weight prenyl acetate, 70.0% by weight aldehyde C 14 SOG, 15.0% by weight manzanate, 30.0% by weight melusate, 200.0% by weight ortho-tert.-butyl cyclohexyl acetate, 5.0% by weight cinnamaldehyde, 10.0% by weight isobornyl acetate, 2.5% by weight dihydrofloriffone TD, 100.0% by weight floramate, 30.0% by weight phenylethyl alcohol, 105.0% by weight geraniol, 150.0% by weight cyclohexyl salicylate and 20.0% by weight citronellol.

Finally, compositions E1" to E6" were also similarly prepared but, in contrast to compositions E1 to E6, contained a perfume oil with a fresh flowery note consisting of 250.0% by weight bergamot oil, 50.0% by weight citrus oil messina, 2.0% by weight citronellal, 50.0% by weight orange oil sweet, 50.0% by weight lavender oil, 50.0% by weight terpineol,100.0% by weight lilial, 80.0% by weight phenyl ethyl alcohol, 100.0% by weight citronellol, 20.0% by weight geraniol, 60.0% by weight benzyl acetate, 50.0% by weight isoraldein 70, 30.0% by weight ylang, 1.0% by weight Ambroxan 10% in IPM, 47.0% by weight heliotropin and 60.0% by weight habanolide.

All the compositions showed two continuous phases which, on shaking, temporarily formed a creamy-looking emulsion. Even after repeated shaking, separate phases again formed after standing.

Storage stability was tested by evaluation of the composition after storage for four weeks at room temperature (20° C.), at elevated temperature (40° C.) and in the cold at a temperature of 5° C. The composition showed no visually discernible change, irrespective of the storage temperature. In particular, the composition could still be reversibly converted into the temporary emulsion by shaking.

The compositions were judged by examiners to be visually attractive and easy to handle and produced good cleaning results in undiluted and diluted form, particularly in the removal of the fatty soils found in the kitchen after the preparation of fat- or oil-containing food.

What is claimed is:

1. A method of cleaning a hard surface, comprising contacting a hard surface in need of cleaning with an aqueous, liquid, multiphase, cleaning composition containing surfactants and having at least two continuous phases, comprising at least a lower aqueous phase I and an upper aqueous phase II immiscible with the lower phase I, which composition can be temporarily converted into an emulsion by shaking, said surfactants comprising more than 50% by weight of nonionic surfactants based on the quantity of surfactants contained in the composition, in an amount and for a time effective to clean the surface.

2. The method of claim 1, wherein a clearly defined phase boundary separates the phases I and II.

3. The method of claim 1, wherein one or both of the continuous phases I and II comprise a part of the other phase as a dispersant.

4. The method of claim 3, wherein one or both of the continuous phases I and II comprise 0.1% to 25% by volume of the other phase as a dispersant.

5. The method of claim 4, wherein one or both of the continuous phases I and II comprise 0.2% to 15% by volume of the other phase as a dispersant.

6. The method of claim 1, wherein phase I is emulsified into phase II in an amount of 0.1% to 25% by volume based on the volume of phase II.

7. The method of claim 6, wherein phase I is emulsified into phase II in an amount of 0.2% to 15% by volume based on the volume of phase II.

8. The method of claim 1, wherein the upper and lower phases I and II form an emulsion between the two phases I and II that is separated from phases I and II by a clearly defined upper phase boundary and a clearly defined lower phase boundary.

9. The method of claim 1, wherein phases I and II have a volume ratio of 90:10 to 10;90.

10. The method of claim 9, wherein phases I and II have a volume ratio of 75:25 to 25:75.

11. The method of claim 10, wherein phases I and II have a volume ratio of 65:35 to 35:65.

12. The method of claim 1, wherein the nonionic surfactants comprise $C_{6-22}$ alkyl alcohol polyglycol ethers, alkyl polyglycosides, or mixtures thereof.

13. The method of claim 1, wherein the composition further comprises one or more anionic surfactants.

14. The method of claim 13, wherein the one or more anionic surfactants are selected from the group consisting of $C_{6-22}$ altkyl sulfates, $C_{6-22}$ alkyl ether sulfates, $C_{6-22}$ alkyl benzenesulfonates, and mixtures thereof.

15. The method of claim 14, wherein at least one anionic surfactant is in the form of its potassium salt.

16. The method of claim 1, wherein the composition comprises one or more nonionic surfactants selected from the group consisting of $C_{6-22}$ alkyl alcohol polyglycol ethers and alkylpolyglycosides and one or more anionic surfactants selected from the group consisting of $C_{6-22}$ alkyl benzenesulfonates, $C_{6-22}$ alkyl sulfates, and $C_{6-22}$ alkyl ether sulfates.

17. The method of claim 16, wherein the nonionic surfactants comprise one or more $C_{6-22}$ alkyl alcohol polyglycol ethers, and the anionic surfactants comprise one or more $C_{6-22}$ alkyl benzenesulfonares.

18. The method of claim 1, wherein the composition further comprises one or more hydrophobic components selected from the group consisting of symmetric or asymmetric $C_{4-14}$ dialkyl ethers, etheritied or esteritfed monomeric or polymeric $C_{2-4}$ alkylene glycols, hydrocarbons having a boiling range of 100 to 300° C., essential oils, and mixtures thereof.

19. The method of claim 1, wherein the composition further comprises one or more phase separation auxiliaries.

20. The method of claim 19, wherein the composition comprises one or more phase separation auxiliaries selected from the group consisting of alkaline metal and alkaline earth metal chlorides and sulfates, and mixtures thereof.

21. The method of claim 1, wherein the composition further comprises one or more builders.

22. The method of claim 21, wherein the composition comprises one or more builders selected from the group consisting of alkali metal citrates, gluconates, nitrilocriacetates, carbonates and bicarbonates, alkali metal and alkaline earth metal hydroxides, ammonia, amines, and mixtures thereof.

23. The method of claim 1, wherein the composition further comprises one or more builders selected from the group consisting of alkali metal, alkaline earth metal, ammonium, and mono-, di- and trialkanolammonium citrates, and mixtures thereof.

24. The method of claim 23, wherein the composition comprises sodium citrate, potassium citrate, or a mixture thereof.

25. The method of claim 1, wherein the composition further comprises one or more perfume oils.

26. The method of claim 1, wherein the composition further comprises one or more enzymes.

* * * * *

UNITED STATES PATENT AND TRADEMARK OFFICE

CERTIFICATE OF CORRECTION

PATENT NO. : 6,689,223 B1
DATED : February 10, 2004
INVENTOR(S) : Meine et al.

It is certified that error appears in the above-identified patent and that said Letters Patent is hereby corrected as shown below:

Title page,
Item [57], ABSTRACT,
Line 7, delete “no”.

Column 17,
Line 52, delete “10;90” and insert -- 10:90 --.

Column 18,
Line 26, delete “etheritied” and “esteritfed” and replace them with -- etherified -- and -- esterified --.

Signed and Sealed this

Fourteenth Day of September, 2004

JON W. DUDAS
*Director of the United States Patent and Trademark Office*